US006209548B1

(12) United States Patent
Harrison et al.

(10) Patent No.: US 6,209,548 B1
(45) Date of Patent: Apr. 3, 2001

(54) METHOD AND APPARATUS FOR NAIL COLORING

(75) Inventors: Richard Earl Harrison; Mary Tara Harrison, both of Dallas, TX (US)

(73) Assignee: Beauty Innovations, Dallas, TX (US)

( * ) Notice: Subject to any disclaimer, the term of this patent is extended or adjusted under 35 U.S.C. 154(b) by 0 days.

(21) Appl. No.: 09/264,259

(22) Filed: Mar. 8, 1999

(51) Int. Cl.[7] ..... A45D 29/18

(52) U.S. Cl. ..... 132/74.5; 132/200; 132/73; 401/206; 401/4

(58) Field of Search ..... 132/74.5, 73, 75, 132/73.5, 75.3, 75.6, 200, 320, 317; 401/196, 198, 206, 4, 202

(56) References Cited

U.S. PATENT DOCUMENTS 4,074,655 * 2/1978 Gross et al. ..... 401/9
4,712,571 * 12/1987 Remz et al. ..... 132/73
4,747,419 * 5/1988 Flynn et al. ..... 132/73
4,749,618 * 6/1988 Kawaguchi et al. ..... 401/196
4,750,502 * 6/1988 Ser et al. ..... 134/74.5
5,747,018 * 5/1998 Valenty ..... 424/61
5,762,077 * 6/1998 Griffiths, Jr. ..... 132/74.5
5,846,012 * 12/1998 Kudo ..... 401/206
5,996,591 12/1999 Landa et al. ..... 132/200

* cited by examiner

*Primary Examiner*—Pedro Philogene
(74) *Attorney, Agent, or Firm*—Fulbright & Jaworski L.L.P.

(57) ABSTRACT

A method and apparatus for applying nail paint is disclosed. In a preferred embodiment a pen-like applicator is provided that comprises a barrel wherein nail paint is contained and a nib that is configured for applying nail paint to a nail. In a preferred embodiment the nib is chisel shaped to allow a user great control and precision around a nail's cuticle and the ability to efficiently apply nail paint to a nail's remaining surface area. The chisel shaped nib may be modified to various shapes, such as bi-concave, plano-concave, or meniscus shapes. Additionally, a nail paint that may be used within the pen-like applicator is disclosed. Preferably, such nail paint is formed by mixing a pigment slurry or past with a latex to form an aqueous nail paint, rather than a traditional solvent-based nail paint. In a preferred embodiment, the nail paint used has a sufficiently low viscosity level to allow the nail paint to effectively flow through the nib, and the nail paint used is preferably non-toxic. Nail conditioning and anti-fungal agents may be included in the nail paint to aid in maintaining healthy nails. Also disclosed is a method for applying nail paint in which a desired color of nail paint having a matte finish is first applied to a nail with a pen-like applicator. Thereafter, a desired finishing formula may be applied to the nail to produce the desired finish. This method results in a nail treatment having the desired appearance, durability and health characteristics.

46 Claims, 3 Drawing Sheets

FIG. 2
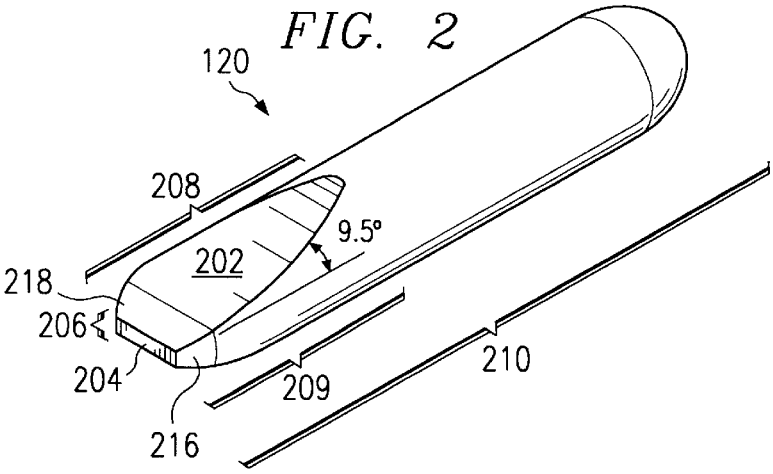
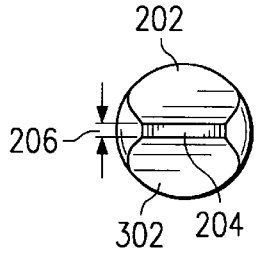
FIG. 3
FIG. 4
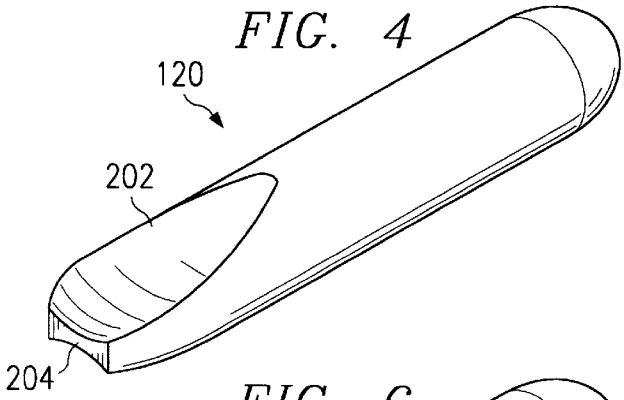
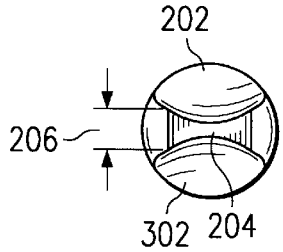
FIG. 5
FIG. 6
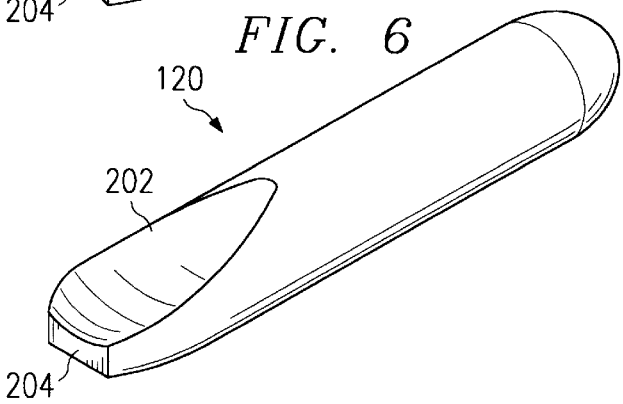
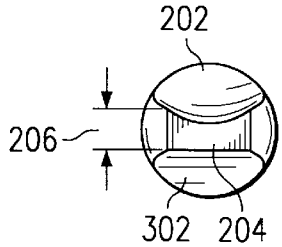
FIG. 7
FIG. 8
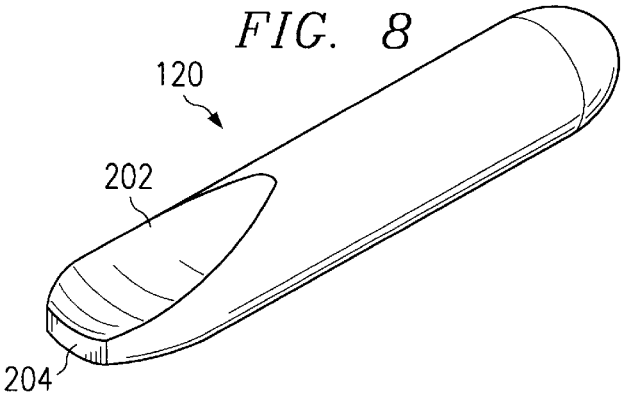
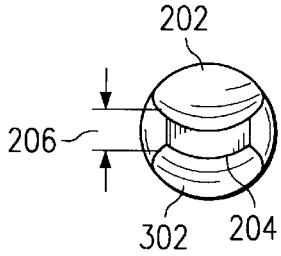
FIG. 9

| MATTE FINISH | GLOSS FINISH | PEARL FINISH | PEARLESCENT FINISH | GLITTER FINISH | MATTE PROTECTOR FINISH |
|---|---|---|---|---|---|
| RED | RED | RED | RED | RED | RED |
| BURGANDY | BURGANDY | BURGANDY | BURGANDY | BURGANDY | BURGANDY |
| PINK | PINK | PINK | PINK | PINK | PINK |
| PURPLE | PURPLE | PURPLE | PURPLE | PURPLE | PURPLE |
| BROWN | BROWN | BROWN | BROWN | BROWN | BROWN |

*FIG. 12*

| RED MATTE FINISH | GLOSS FINISH | PEARL FINISH | PEARLESCENT FINISH | GLITTER FINISH | MATTE PROTECTOR FINISH |
|---|---|---|---|---|---|
| BURGANDY MATTE FINISH | | | | | |
| PINK MATTE FINISH | | | | | |
| PURPLE MATTE FINISH | | | | | |
| BROWN MATTE FINISH | | | | | |

*FIG. 13*

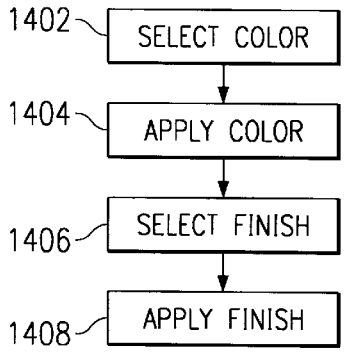

*FIG. 14*

METHOD AND APPARATUS FOR NAIL COLORING

TECHNICAL FIELD

The invention relates in general to nail paint, applicators for applying nail paint, and methods for applying nail paint. This invention relates in specific to an aqueous-based nail paint having a viscosity sufficiently low to effectively flow through a pen-like applicator, a pen-like applicator having a nib configured for precisely applying nail paint to a nail, and a method for applying a nail treatment yielding the desired durability, appearance and health characteristics wherein an aqueous-based nail paint is first applied and then a solvent-based finish is applied.

BACKGROUND

In the prior art, nail polish is typically applied to finger and toe nails using a brush. Traditionally, nail polish is provided in jar containers, and a fiber brush that is attached to a plastic stick is used to apply the nail polish to nails. Such nail polish is typically a very thick, viscous, solvent-based solution. The process of applying nail polish in this traditional manner is very time consuming. The viscosity of such nail polish typically causes a large amount of nail polish to attach to the brush. Thus, when the brush is dipped into a jar of nail polish, the brush typically receives more nail polish than is required. Being unable to effectively control such a large amount of polish in applying it to a nail, the user typically tries to reduce the amount of excess nail polish on the brush by scraping the brush against the opening edge of the jar. However, if the user scrapes off too much nail polish, the polish will streak when applied to the user's nail or will provide insufficient covering. Thus, care must be taken in obtaining just the right amount of nail polish on the brush.

Brush thickness also contributes to the inconvenience of applying traditional nail polish. Because of the thickness of brushes typically used for applying nail polish, such brushes cannot be applied against the user's cuticle without getting unwanted polish on the cuticle. Instead, care and skill must be utilized to apply pressure on the bristles of a brush against the user's nail to force polish up to the edge of the cuticle. Thus, by pressing the brush against the user's nail, a "wave" or "ridge" of polish can be pushed up to the edge of the user's cuticle. This is the accepted, traditional technique for applying nail polish to a nail using the traditional brush applicator. This technique requires that a certain care and skill be utilized by the user to obtain the desired result. Using the prior art brush to apply nail polish up to the edge of the cuticle without actually getting nail polish on the cuticle is a very delicate process. If the user makes a mistake and places nail polish on the cuticle, nail polish remover must be applied to remove the unwanted polish. Removing such unwanted polish from the cuticle without placing any nail polish remover on the surface of the user's nail is also a very tedious process. In attempting to remove the polish from the cuticle, a user will often inadvertently apply nail polish remover to the surface of the user's nail, and thus ruin the desired finish. Accordingly, a user will often be required to remove the nail polish completely and begin again the process of applying polish to the user's nail.

As described above, because of the nature of the prior art applicator brush and nail polish, a user is required to employ a very methodical, slow, deliberate, delicate, cautious technique in applying nail polish to the user's nails. Such a technique is very time consuming. Furthermore, considering that a user often is required to remove polish and start the process over in order to correct mistakes, the prior art technique for applying nail polish becomes even more time consuming. Additionally, applying a first coat of nail polish utilizing a prior art applicator brush and nail polish often results in an undesirable finish. That is, the nail polish may have ridges, streaking, or thin spots in color on the surface of the user's nails. As a result, a user is often required to apply multiple coats of nail polish to achieve a desired finish. Thus, a user is required to wait for the first coat to dry and then utilize the above-described technique to apply an additional coat. Applying multiple coats of polish increases the amount of time necessary to obtain a desired finish for the nail polish.

Prior art nail polish has traditionally been packaged in vials or jars of various shapes and sizes. Such containers typically provide approximately ½ ounce in volume of nail polish. Because of the various shapes of the prior art nail polish jars, it is typically difficult to extract all of the nail polish from the jars using the traditional applicator brush. Generally, the applicator brush must be inserted vertically into the nail polish jar. Because of the difficulty in getting the brush to reach locations of the jar where nail polish resides, a user typically rotates the container to various positions in order to direct nail polish to the tip of the brush. Thus, the shape of most prior art containers make it very difficult to access all of the nail polish.

Additionally, because of the nature of prior art nail polish, it dries out quickly. That is, prior art nail polish is viscous and generally contains drying agents to decrease the amount of time that it takes for the polish to dry after it is applied to a user's nail, causing it to dry out quickly. Therefore, if the nail polish container is open for an extended period of time, the nail polish tends to harden. Moreover, this hardening process typically occurs even when the container has remained closed because the typical nail polish container is not perfectly air tight. As the nail polish hardens, it becomes gummy, gooey, and unusable. This hardening characteristic of prior art nail polish is particularly problematic given the fact that applying such prior art nail polish is typically a very time consuming process, as discussed above, and the user typically maintains an inventory of different colors which are used relatively infrequently. Accordingly, a prior art container of nail polish typically spoils or hardens to a point that it is unuseable long before a user can deplete the entire container. Therefore, much of the prior art nail polish is typically wasted.

Some types of prior art nail polish, generally referred to as "quick drying nail polish," contain additional drying agents that decrease the amount of time necessary for the polish to dry after applying it to a nail. However, such quick drying nail polish still does not dry quickly enough to recognize a substantial difference in the amount of time required in the application process. Moreover, quick drying nail polish typically does not bond with the nail particularly well, often resulting in chipping. Typically, within two days of applying such quick drying nail polish a user is required to "touch-up" the user's nail polish because the polish does not bond to the user's nail and chips off. Accordingly, this may actually increase the total amount of time spent on applying and touching-up a user's nail polish over the long run. Furthermore, the additional chemicals utilized in quick drying nail polish may irritate and dry-out the nail and the surrounding skin.

Moreover, it is very difficult to perform touch-ups utilizing prior art applicators and nail polish. Prior art nail polish typically does not blend or bond very well with previously applied polish. As a result, a touch-up typically results in a variance in the coloration and texture of the nail polish. That is, the color applied in a touch-up typically does not blend with the color of the previously applied nail polish. Also, it is very difficult to fill in a chipped nail surface through performing a touch-up and achieve a uniform, smooth surface.

Prior art nail polish is typically available in a variety of finishes, including matte, gloss, pearl, pearlescent, glitter, and protectant finishes. A matte finish is very versatile and may be made into a variety of other types of finishes by applying a desired finish on top of the matte finish. That is, once a matte finish is applied to a nail, it may be made into a desired finish, such as gloss or glitter, by applying a clear coat of the desired finish formula after the matte finish has been applied. However, other types of finishes are less versatile and may be incapable of being converted into a desired finish. For example, a gloss finish cannot be made into a matte finish. As another example, a glitter finish cannot be made into a plain gloss finish or a matte finish. Thus, if a user desires the option of having a particular color in a gloss, glitter, and matte finish, the user may purchase three different products of the same color. As a result, a user may purchase multiple formulations of the same color of nail polish. Thereafter, if the user desires to have a different color in gloss, glitter and matte finishes, the user may purchase three additional products of that color (i.e., one product for each desired finish). Therefore, to have a desirable number of finishing options and colors available to a user, a user may obtain many different finishes, each in variety of different colors.

Additionally, prior art nail coloring products are typically solvent-based formulas that utilize numerous toxic chemicals that are hazardous to a user's health and to the environment. For example, prior art nail coloring products typically contain formaldehyde and toluene. Toluene, which is an aromatic solvent, is particularly hazardous in that it is a known carcinogen. These and other chemicals utilized in prior art nail coloring products are highly toxic and present a danger to a user's health if ingested or inhaled. As a result, prior art nail polish is especially problematic for small children who may ingest the harmful product.

Also existing in the prior art are various pens, markers, highlighters, and other writing utensils. Typically, such writing utensils have a long barrel with a nib on one end of the barrel for marking. Such prior art writing utensils are intended for writing, drawing, and otherwise marking on various surfaces. However, such writing utensils have not been adapted to apply nail polish and are not readily useable for that task. First, the various nibs available on such writing utensils are generally not user-friendly for applying nail polish. That is, some markers have felt tips, which are generally wide and produce a wide mark. Such wide-tip markers are difficult to use on a nail without inadvertently marking on areas around the nail, such as the cuticle. Other nibs used for various writing utensils have fine points of varying degrees. The fine points utilized by most writing utensils are rounded to a point that is too fine for efficiently applying nail polish. Writing utensils with rounded, fine points are only able to make small lines on a nail, causing the application process to take a long time and resulting in a streaked effect.

Moreover, the ink used by various writing utensils is not readily adaptable for use as a nail polish. Generally, the ink used by writing utensils does not provide the desired color opacity that is produced by a nail coloring product, such as traditional nail polish. Some ink produces a "staining" of the nail, as opposed to being a surface coating like traditional nail polish. Additionally, some ink does not bond with a nail, which results in the ink being easily rubbed off or smeared, or the ink may simply produce "beads" of ink on the nail. The coating effect of traditional nail polish serves to provide support and protect nails. However, merely staining the nail or applying ink that does not bond with a nail does not provide such support or protection for nails. Replacing the traditional ink used in such writing utensils with prior art nail polish has also not been a viable alternative because of the viscosity of prior art nail polish. That is, prior art nail polish is generally too viscous to flow effectively through the nibs of prior art writing utensils.

Also available in the prior art is a "paint pen" manufactured by the Hunt Corporation. Such a pen has a long barrel that contains non-toxic paint used for art projects. The pen further has two nib options, a relatively thick, rounded, polyester nib, and a chiseled, polyester nib, both of which are used to apply the paint. The pen also has a valve that forms a seal preventing the paint from inadvertently leaking out of the pen. The valve and nib are aligned such that when sufficient inward pressure is applied to the nib it causes the valve to open, allowing paint to flow from the barrel of the pen to the nib. The paint pen has the appearance of a thick magic marker, and has typically been provided as a "clean" utensil for children to use in creating art projects. That is, the paint pen is less messy for art projects than the paint and brushes traditionally used for such art projects.

However, the paint pen has not been adapted for applying nail polish and without substantial modifications, the paint pen is not an effective utensil for nail painting. The primary problems with using the prior art paint pen for nail painting reside within the design of the pen's nib. First, both the rounded and chiseled nibs are too thick or "fat" to have the precision necessary to apply paint up to the edge of a nail's cuticle without inadvertently applying paint on the cuticle. Moreover, the large, magic marker appearance of the prior art paint pen does not conform to the generally sleek appearance of beauty products. Lastly, the prior art does not contemplate the process of applying a solvent based finish over previously applied aqueous color, which is necessary to provide a desired finish and necessary durability. Thus, the prior art paint pen has not provided a viable alternative for applying nail paint, absent substantial, non-obvious modifications.

Additionally, pen-like nail polish applicators have been developed in the prior art, such as that disclosed in U.S. Pat. No. 4,712,571. However, the nib design and polish formula utilized in such prior art applicators have not proven successful in applying nail polish to a nail. More specifically, traditional nail polish is much too viscous to effectively flow through such a pen-like applicator. Prior art attempts have been made to utilize a nail polish having a viscosity sufficiently low to allow the polish to flow through the applicator to a nail. For example, U.S. Pat. No. 4,712,571 discloses a solvent-based, lacquer nail polish having a viscosity not greater than 200 centipoise (cps). However, prior art attempts have been unsuccessful in providing a quality nail polish that may be applied easily and effectively using a pen-like applicator. One problem with prior art nail polish capable of being utilized in a pen-like applicator is that such nail polish has been less durable than desired. That is, such nail polish typically chips or cracks a short time after being applied to a nail. Additionally, the nib provided in such prior art applicators is too soft to be utilized for delivering an aqueous color solution, and the nib has not been shaped or configured to allow easy, effective application of an aqueous color solution to a nail.

SUMMARY OF THE INVENTION

Because of the above-described problems with the prior art methods and applicators used for applying nail polish, there exists a desire for a nail coloring or "painting" method and applicator that allows a user to easily and quickly apply a coat of aqueous color or "nail paint" followed by a coat of solvent-based finish to the nails thereby creating a film which provides the user with the desired nail appearance, durability and health characteristics. There is a further desire for a nail painting applicator that allows a user to easily apply the nail paint up to the edge of the user's cuticle without placing paint on the cuticle. There is a further desire for a nail painting applicator that preserves the life of the paint so that the paint does not harden or spoil quickly. There is a further desire for a nail painting applicator that reduces the amount of streaking, discoloration, and other flaws that typically results when utilizing existing applicators or writing utensils to apply nail color.

There is a further desire for a nail painting method and applicator that allows touch-ups to be performed easily and quickly, and which results in a desired finish having a consistent color and consistent texture. There is still a further desire for a nail painting method and applicator that allows a user to apply a matte finish nail paint, which can thereafter be made into a variety of desired finishes by applying the desired finish after the matte finish nail paint has been applied. Thus, there is a desire for a method of applying nail paint, wherein a user may easily and effectively apply a coat of nail paint and thereafter adapt the applied nail paint to a desired finish, thereby reducing the number of formulas that must be obtained to achieve the same variety of colors and finishes. There is yet a further desire for a nail paint that is non-toxic, environmentally safe, and provides a desired coat of nail paint when applied to a nail. There is still a further desire for a nail paint that is substantially water-based, rather than solvent-based, and there is a desire for such a nail paint that has a viscosity level sufficiently low to allow effective flow through a pen-like applicator. Further, there is a desire for such a nail paint that bonds well with a nail and with a solvent-based nail finish thereby creating a film, which has the desired appearance, durability, and health characteristics.

These and other objects, features and technical advantages are achieved by a method and apparatus for nail painting which utilizes a "nib" that is specially configured to distribute nail paint to a nail, rather than using a traditional brush applicator. In a preferred embodiment, a pen-like applicator having a barrel to contain nail paint is provided. Additionally, in a preferred embodiment, the applicator has a valve that creates a sufficiently air tight seal to prevent the nail paint contained within the applicator's barrel from leaking and to reduce drying of the nail paint contained within the applicator's barrel. Preferably, such valve operates to open when sufficient pressure is applied inward on the nib, allowing nail paint to flow from the barrel through the valve to the nib.

Further, in a preferred embodiment, the applicator has a finely shaped nib which may distribute nail paint contained within the applicator's barrel to a nail. The nib is configured in a manner that allows a user to easily apply nail paint up to the edge of the cuticle with great precision. In a preferred embodiment, the nib has a chisel shape with a radius on each corner of the tip, which allows the user to apply nail paint quickly and with great precision. Such curved corners allow a user to easily apply nail paint against the cuticle of a nail without getting nail paint on the cuticle, particularly the severely curved portions of the cuticle. Note that a squared chisel would ride up over the edge of the cuticle. Utilizing such a nib virtually eliminates the possibility of mistakenly applying paint on or beyond the cuticle. Accordingly, the necessity of using remover and re-applying paint to correct such mistakes is virtually eliminated. Moreover, because of such a nib's precision and its ease of use, the time and difficulty associated with applying nail paint may be significantly reduced.

Additionally, in a preferred embodiment, a non-toxic nail paint is utilized as the coloring medium. Such nail paint has a viscosity level that permits the nail paint to effectively flow from the barrel of the applicator through the applicator's nib. In a preferred embodiment, such nail paint is substantially water-based, rather than solvent-based. For example, in a preferred embodiment, such nail paint composition is formed by mixing a pigment slurry with a latex. Moreover, the nail paint bonds well with the nail, with itself and with various solvent based finishes, which increases durability and allows touch-ups to be easily performed resulting in a consistent texture and color. Preferably, the nail paint dries very quickly to reduce the possibility of smudging and the overall time required for applying the nail paint, and may be removed from a nail utilizing well-known, existing nail polish remover. Also, additional substances, such as nail conditioning and anti-fungal agents, may be added to the paint solution.

Moreover, in a preferred embodiment such nail paint is available in a matte finish. Thus, a user may first utilize an applicator having a nib shaped for applying the nail paint to a nail to apply a matte finish nail paint having a desired color. Thereafter, the user may apply a desired finishing formula, such as gloss, pearl, pearlescent, glitter, or matte protectant, to the nail. The desired finishing formula may be applied using an applicator having a nib shaped for applying the finishing formula to a nail if the finishing formula has a viscosity level sufficiently low to allow effective flow through such an applicator and which bonds sufficiently with the paint and nail. Alternatively, a traditional brush applicator or any other applicator now known or later developed may be used to apply such a finishing formula. Thus, in a preferred embodiment, the existing method for applying nail polish is bifurcated into a two-step process; first the user applies a paint having the desired color in a matte finish and then applies a desired finishing formula.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which:

FIG. 2 shows a preferred embodiment of a nib used in a nail paint applicator;

FIG. 3 shows a frontal view of a preferred embodiment of a nib used in a nail paint applicator;

FIG. 4 shows a first alternative embodiment of a nib used in a nail paint applicator;

FIG. 5 shows a frontal view of a first alternative embodiment of a nib used in a nail paint applicator;

FIG. 6 shows a second alternative embodiment of a nib used in a nail paint applicator;

FIG. 7 shows a frontal view of a second alternative embodiment of a nib used in a nail paint applicator;

FIG. 8 shows a third alternative embodiment of a nib used in a nail paint applicator;

FIG. 9 shows a frontal view of a third alternative embodiment of a nib used in a nail paint applicator;

FIG. 12 shows an exemplary table demonstrating a possible combination of products required for desirable combination in the prior art;

FIG. 13 shows an exemplary table demonstrating the number of products that may be obtained in a preferred embodiment; and FIG. 14 shows an exemplary flow chart for a two-step method of applying nail paint having a desired finish in a preferred embodiment.

DETAILED DESCRIPTION

Figure 1:
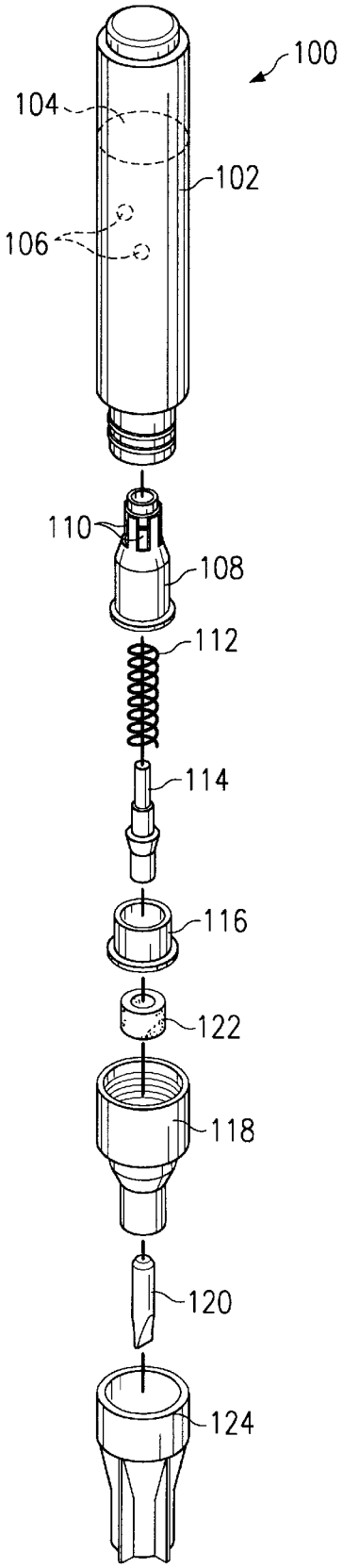
FIG. 1 shows a preferred embodiment of a nail paint applicator.

Turning to FIG. 1, a preferred embodiment of a pen-like nail paint applicator 100 is shown. As illustrated, the preferred embodiment has a barrel 102, in which nail paint 104 may be stored. Preferably, the barrel 102 may be made of a transparent substance possessing adequate vapor barrier characteristics, such as a transparent polypropylene, acrylic, or polycarbonate substance, wherein nail paint 104 contained within barrel 102 may be viewed. Accordingly, such a transparent barrel allows a user to easily determine the color of the nail paint 104, as well as the amount of such paint 104 remaining within barrel 102. Alternatively, the barrel 102 may be made of a non-transparent substance possessing adequate vapor barrier characteristics, such as non-transparent polypropylene, acrylic, or polycarbonate substance. In yet another alternative, barrel 102 may be made of a metal substance, such as steel, stainless steel or aluminum, possessing adequate vapor barrier characteristics. Also, one or more solid-form "mixing pellets" 106 may be contained within barrel 102, such that when the applicator is shaken the mixing pellets 106 assist in effectively mixing the nail paint 104.

A "casing" 108 is also provided, which contains one or more apertures (which may also be referred to as "openings" or "holes") 110. Casing 108 also provides a "drum" portion 116. Casing 108 houses a spring 112 and a valve 114. Spring 112 is situated such that it maintains outward pressure on valve 114 to effectively seal the opening to drum 116 closed. Although, when sufficient inward pressure is applied on valve 114, spring 112 coils allowing valve 114 to move inwardly. As valve 114 moves inward, an opening is created into drum 116, which allows nail paint 104 to flow from barrel 102 through apertures 110 into drum 116. When sufficient inward pressure is no longer applied on valve 114, spring 112 uncoils causing valve 114 to again effectively seal the opening to drum 116. Such an arrangement for providing a valve seal is well known in the art, and any similar method for implementing such a valve seal may be utilized within nail paint applicator 100. Any such valve seals now known or later developed are intended to be within the scope of the present invention.

In a preferred embodiment, the nail paint applicator 100 also has an "end housing" 118, which houses a nib 120 and a foam seal 122. Nib 120 is moveable within end cap 118, such that when sufficient inward pressure is applied on nib 120 it moves inwardly. In turn, as nib 120 moves inwardly, it applies inward pressure against valve 114, such that as sufficient pressure is applied, spring 112 coils allowing valve 114 to move inwardly, as explained above. When valve 114 moves inwardly nail paint 104 is allowed to flow into drum 116 and reach nib 120. Foam seal 122 absorbs any excess amount that may flow over nib 120, thus preventing the applicator from dripping nail paint.

As shown in FIG. 1, casing 108 fits securely within barrel 102, which in turn attaches securely to end housing 118. As a result, an easy-to-use nail paint applicator 100 is formed. Additionally, in a preferred embodiment an "end cap" 124 is provided, which may be removeably attached to end housing 118. End cap 124 works to enclose nib 120 to prevent nail paint from being accidentally applied from nib 120 to anything else and to reduce drying of nail paint residing on nib 120. End cap 124 may be covered by an additional decorative cap.

The preferred embodiment shown in FIG. 1, allows a user to apply nail paint as follows. First, a user may shake the applicator to effectively mix the nail paint solution. The user then temporarily exerts inward pressure on the applicator's nib (such as by pressing it against the user's nail), which opens the valve and allows a volume of nail paint to flow to the nib. Thereafter, the user stops applying inward pressure allowing the nib to fully extend and the valve to re-seal the barrel. The user then applies the nail paint that resides in the nib. As more nail paint is desired, the user reapplies inward pressure to the nib, which causes the valve to open and allows additional nail paint to flow to the nib. Thus, the nail paint contained within the barrel is typically sealed and is exposed only during the brief periods when inward pressure is exerted against the nail to obtain additional nail paint. Accordingly, the nail paint stored within the applicator's barrel does not spoil or harden as quickly as prior art nail polish contained in jars or vials. The nail paint stored within the applicator's barrel may have a shelf life of 1 to 2 years, or longer, after the applicator is first used. In contrast, prior art nail polish contained in jars or vials typically becomes unusable 3 to 6 months after being first used.

Focusing now on nib 120, such nib may be designed to allow optimal nail paint flow from the applicator's barrel 102 through nib 120 and provide precise control during the application process. Turning to FIG. 2, a preferred embodiment of nib 120 is illustrated. As shown in FIG. 2, in a preferred embodiment nib 120 has substantially a chisel shape. Such a chisel shape enables the user to push nib 120 against a nail cuticle without having the nail paint flow over the cuticle and onto the finger. Nib 120 tapers gradually to the end point (or "edge") 204. As shown, surface 202 slopes downward to end point 204. The height of end point 204 is illustrated by height 206 in FIG. 2. Height 206 is preferably very fine to allow a user better control in applying nail paint around the user's cuticle. Ideally, the nib 120 would gradually taper to a very thin, narrow end point 204 that would have the height 206 similar to that of a razor blade. However, height 206 should be sufficient such that the nib 120 maintains is structural integrity during and after inward pressure has been applied to release the paint 104.

However, the height 206 may be limited by the material of nib 120. In a preferred embodiment, nib 120 is made of an acrylic fiber cross-linked with a fully reacted crystalizing resin, or another acrylic or polymer material. The material forms a "wick" type of nib that allows nail paint to effectively flow through it. Such a nib may be formed into a chisel shape having a fine end point 204, wherein the end point 204 is as fine as is possible such that the integrity of the nib is not lost during use. That is, end point 204 may be as fine as possible without the shape of the nib 120 becoming distorted due to the force applied when the nib is depressed or grains from the nib becoming dislodged due to abrasion, both associated with the application process. Accordingly, the physical properties of the material and manufacturing process associated with the nib provides the limitation on how small height 206 may be made. Height 206 may be made as small as possible, as long as the structural and surface integrity of the nib are maintained during use of the applicator. The preferred embodiment currently has a height 206 that is preferably less than approximately 2 millimeters and most preferably less than approximately 1 millimeter (mm) or approximately 0.05 inches. However, such height 206 may be reduced or increased, and any such reduction or increase is intended to be within the scope of the present invention. Preferably, the porosity of nib 120 is maintained to allow optimal flow of nail paint through the nib. That is, the porosity of the nib's texture is preferably maintained to allow even, optimal flow throughout the nib. Accordingly, the nib's texture is preferably consistent throughout, such that not too much and not too little nail paint flows to any given area of the nib during proper usage of the applicator. In a preferred embodiment the slope of sides 208 and 209 shown in FIG. 2 is very gradual. Preferably, the slope is gradual making it easier for a user to view the top surface of nib 120 to guide the bottom surface of nib 120 against a nail as desired. Thus, a gradual slope improves a user's precision and control over the applicator. To further improve a user's precision and control, in a preferred embodiment, nib 120 extends from the end of the applicator far enough to allow a user to have clear visibility of the area to which nail paint is being applied. That is, nib 120 is of a length that allows it to extend far enough from the end of the applicator's barrel so that the barrel does not block a user's view of the area to which the user is applying nail paint.

For example, in a preferred embodiment the total length 210 of nib 120 is preferably within the range of approximately 0.66 inch to approximately 3 inches, and most preferably the total length 210 is approximately 1 inch. However, the length 210 may be substantially increased or decreased in alternative embodiments and any such modification is intended to be within the scope of the present invention. As a further example, the length of sloping sides 208 and 209 is preferably within the range of approximately 0.18 inches to approximately 0.75 inches and most preferably is approximately 0.375 inches (or approximately 9.5 millimeters) in a preferred embodiment. However, the length of sloping sides 208 and 209 may be substantially increased or decreased in alternative embodiments and any such modification is intended to be within the scope of the present invention. As still a further example, in a preferred embodiment the sides 208 and 209 preferably tapers at an angle within the range of approximately 7° (degrees) to approximately 15° and most preferably tapers at approximately a 9.5° angle, as illustrated in FIG. 2. However, the angle at which sides 208 and 209 taper may be substantially increased or decreased in alternative embodiments, and any such alternative embodiment is intended to be within the scope of the present invention.

Additionally, in a preferred embodiment the corners 216 and 218 of the nib 120 may be curved. The radius of the curvature of corners 216 and 218 may vary, and a curvature having any radius is intended to be within the scope of the present invention. In a preferred embodiment, the radius of the curvature of corners 216 and 218 is within the range of approximately 0.1 inch to less than infinity (wherein infinity is no curvature). However, in alternative embodiments the radius of the curvature of corners 216 and 218 may be substantially increased or decreased.

In a preferred embodiment, the volume capacity of the nib 120, which is a function of its porosity, length, diameter and shape as described above, and the composition of the nail paint, is limited to that capacity which is necessary to apply color to no more than 10 nails. However, the volume capacity of nib 120 may be substantially increased or decreased in alternative embodiments and any such modification is intended to be within the scope of the present invention.

Turning now to FIG. 3, a frontal view from the end of nib 120 is shown. As illustrated, sloping surface 202 and sloping surface 302 taper to form a chisel shape having an edge 204. As discussed above, height 206 of edge 204 is preferably small enough to allow a user to apply nail paint to the edge of a nail's cuticle without flowing over onto the cuticle, while still being large enough to allow the nib to maintain its integrity. Such a chisel shape allows a user to use the narrow edge 204 to easily apply nail paint up to a nail's cuticle with great precision. Additionally, the chisel shape allows a user to utilize the sloping surfaces 202 and 302 to quickly apply nail paint to the remaining surface area of a nail. Thus, the surfaces 202 and 302 of nib 120 allow a user to cover a larger surface area more quickly. Accordingly, the chisel shape provides a user with great control and precision, and decreases the amount of time associated with the application process.

As described above, in a preferred embodiment nib 120 is of an acrylic or polymer substance. Although, various other substances may be utilized to form a substantially fibrous material for nib 120. The scope of the present invention is intended to encompass a nib having the characteristics described herein, regardless of the substance(s) utilized to form such a nib. In a preferred embodiment, the nib may be reconditioned (i.e., cleansed) by simply rinsing it with water. For example, if a user leaves the end cap off of the nib for an extended period of time and the nib dries out, it can be cleansed by simply rinsing the nib with water. Moreover, nib 120 may be removeable from end housing 118 and replaced with another nib. Thus, should a nib become lost, damaged, or unusable for any reason, a user may replace the nib at minimal cost. Moreover, nibs of varying shapes and sizes may be available. For example, a very fine nib convenient for applying fine designs to a nail may be utilized within the nail paint applicator to create designs on a nail. It should be understood that leaving the end cap off of the end housing may cause nib 120 to dry out, but valve 114 works to prevent drying or hardening of the nail paint contained within barrel 102. With prior art nail polishing products, if the cap or lid is left off of the nail polish container for an extended period of time, the entire supply of nail polish contained therein dries out.

Various modifications may be made to the chisel nib 120 and still be within the scope of the present invention. For example, as illustrated by FIGS. 4 and 5, nib 120 may be slightly rounded or curved to more accurately conform to the shape of a nail. As FIGS. 4 and 5 illustrate, nib 120 may have a "bi-concave" shape, in which both the top surface 202 and the bottom surface 302 are slightly rounded. Thus, each surface may be curved slightly similar to that of a spoon. Utilizing this bi-concave embodiment, a user may apply nail paint to a curved nail with either of the slightly curved surfaces. The terms "top" and "bottom" are used for reference purposes only, and are not intended to be limitations on the scope of the present invention. At any given time, either side may be considered the top or the bottom, depending on how the nib is being used.

In a preferred embodiment, the radius of curvature of the top surface 202 is approximately equal to the radius of curvature of the bottom surface 302. However, in alternative embodiments the radius of curvature may be different for the top surface 202 and the bottom surface 302. For example, the top surface 202 may have a larger radius of curvature that may be more suitable for an average fingernail, while the bottom surface 302 may have a smaller radius of curvature that may be more suitable for an average toe nail. Preferably, the edge 204 is still present with a small height 206 to provide control and precision around a nail's cuticle. By slightly curving surfaces 202 and 302 to conform more accurately to the curve in most nails, nib 120 may apply a smooth coating to a nail more quickly and efficiently. That is, slightly curved surfaces 202 and 302 may increase the smoothness and reduce the number of strokes required to apply nail paint to a nail. A potential problem with this alternative design is that nail paint may not flow evenly along the nib. For example, a disproportionate amount of nail paint may congregate in one area of the nib, leaving too little nail paint in another area.

A further example of a modification that may be made to the chisel-shaped nib 120 is shown in FIGS. 6 and 7. Nib 120 may be slightly rounded or curved to more accurately represent the shape of a nail on only one side. As shown in FIGS. 6 and 7, the nib may have a "plano-concave" shape, in which the top surface 202 is slightly rounded and the bottom surface 302 remains substantially flat. Thus, surface 202 may be curved slightly similar to that of a spoon. The terms "top" and "bottom" are used for reference purposes only, and are not intended to be limitations on the scope of the present invention. At any given time, either side may be considered the top or the bottom, depending on how the nib is being used.

Utilizing this plano-concave embodiment, a user may apply nail paint to a curved nail with the slightly curved surface 202, and apply nail paint to a relatively flat nail with surface 302. For example, a user's ring finger may have a slightly curved nail, while the user's thumb may have a relatively flat nail. This plano-concave embodiment would provide such a user with the option of using slightly curved surface 202 on the user's ring finger nail and using surface 302 on the user's thumb nail. Preferably, edge 204 is still provided with a small height 206 to provide control and precision around a nail's cuticle. By slightly curving surface 202 to conform more accurately to a slightly curved nail, nib 120 may apply a smooth coating to such a curved nail quickly and efficiently. At the same time, the substantially flat surface 302 may be utilized to quickly and efficiently apply nail paint to a relatively flat nail. Additionally, substantially flat surface 302 may aid in maintaining an even flow of nail paint along nib 120.

Yet a further example of a modification that may be made to the chisel-shaped nib 120 is shown in FIGS. 8 and 9. Nib 120 may be slightly rounded or curved to more accurately represent the shape of a nail. As shown in FIGS. 8 and 9, nib 120 may have an overall curved shape, in which top surface 202 is slightly rounded and bottom surface 302 is also rounded coincidentally with top surface 202. Thus, surfaces 202 and 302 may be coincidentally curved similar to a spoon. The terms "top" and "bottom" are used for reference purposes only, and are not intended to be limitations on the scope of the present invention. At any given time, either side may be considered the top or the bottom, depending on how the nib is being used. Utilizing this "coincidentally curved" embodiment (which may also be referred to as a "meniscus" or "crescent" embodiment), a user may apply nail paint to a curved nail with the slightly curved surface 202. Preferably, the edge 204 is still provided with a small height 206 to provide control and precision around a nail's cuticle. By slightly curving surfaces 202 and 302 to conform more accurately to the curve in most nails, nib 120 may apply a smooth coating to a nail quickly and efficiently. That is, slightly curved surface 202 may increase the smoothness and reduce the number of strokes required to apply nail paint to a nail. Additionally, curving surface 302 coincidentally with surface 202 may aid in maintaining an even flow of nail paint along nib 120.

Figure 10:
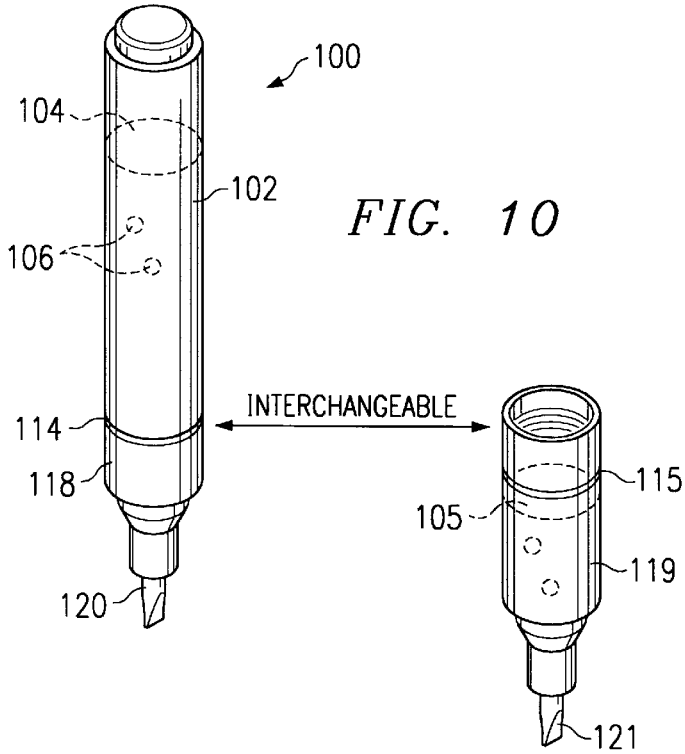
FIG. 10 shows a nail paint applicator having an interchangeable end housing.

Various modifications may be made to nail paint applicator 100 without diverting from the scope of the present invention. An example of such a modification is illustrated by FIG. 10. In a preferred embodiment, end housing 118 may not be readily removable from barrel 102, and thus may not be interchangeable with other end housings. However, as shown in FIG. 10, end housing 118 may be removed from barrel 102 and replaced with a different end housing 119 in an alternative embodiment. In such an alternative embodiment, end housing 118 may be interchangeable with other end housings, such as end housing 119. For example, threads may be provided on the barrel 102 and on each end housing 118 and 119, such that end housing 118 and 119 may each be securely screwed into place on barrel 102. Valve 114 works to prevent nail paint 104 from flowing or leaking from barrel 102. Likewise valve 115 works to prevent nail paint 105 from flowing or leaking from end housing 119. It should be understood that because valve 115 is not required to open at any time, it may be sealed closed. In fact, valve 115 may simply be an enclosing wall to prevent end housing 119 from leaking.

By utilizing the embodiment shown in FIG. 10, a user may apply nail paint 104 having a matte finish with end housing 118 attached to barrel 102. Thereafter, a user may replace housing 118 with housing 119 and apply a gloss finish (or other finish) 105. Alternatively, end housing 119 may contain nail paint 105 that is a different color than nail paint 104. Thus, a user may utilize a single barrel 102 to which different housings 118 and 119 may be attached to apply separate coatings to a nail.

Alternatively, barrel 119 may have a lid (not shown) with a brush applicator (not shown) for applying the contents of barrel 119, rather than nib 121. In this alternative embodiment, such a brush applicator may be dipped into barrel 119 and applied to a nail. For example, if barrel 119 contains nail gloss that is too viscous to effectively flow through nib 121, such a lid (or cap) with a brush applicator may be provided for barrel 119 to allow a user to apply such nail gloss. Thus, such an alternative modification allows a user to utilize a nib 120 to apply the contents of barrel 102 and utilize a brush applicator (not shown) to apply the contents of barrel 119. A stand (not shown) may also be provided to support the applicator 100. Such a stand may aid in preventing the applicator 100 from tipping over and spilling the contents of barrel 119 during the application of such contents by a user.

Figure 11:
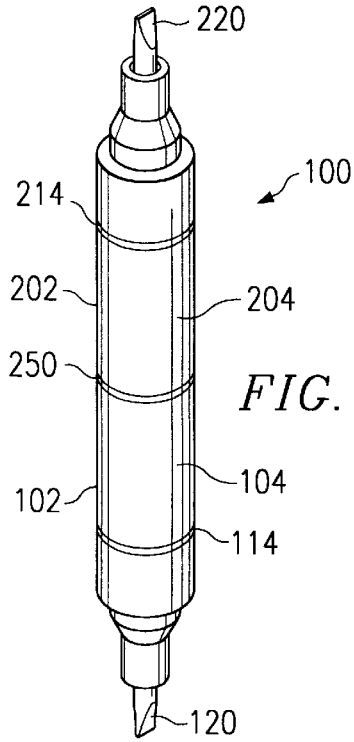
FIG. 11 shows a dual nail paint applicator having two separate nibs.

Another example of a modification that may be made to nail paint applicator 100 is illustrated by FIG. 11. As shown in FIG. 11, this modification supplies essentially two separate applicators joined together forming a "dual" nail paint applicator. The dual nail paint applicator has a barrel 102 containing nail paint 104 and valve 114, which works to prevent nail paint 104 from flowing inadvertently. The applicator also has a nib 120 used for applying nail paint 104. Additionally, the applicator has a second barrel 202, which contains nail paint 204 and valve 214, which works to prevent nail paint 204 from flowing inadvertently. A nib 220 is also provided, which is used for applying nail paint 204. As shown, the applicator has a divider 250, which effectively seals the contents of barrel 102 from barrel 202 and vice-versa. Barrel 102 may contain a nail paint 104 having a certain color, while barrel 202 contains nail paint 204 having a different color. Alternatively, barrel 102 may contain a nail gloss 104 or other nail finish, while barrel 202 contains nail paint 204. Divider 250 may be located such that barrels 102 and 202 are approximately equal in size, or divider 250 may be located such that one barrel is larger than the other. The modification shown in FIG. 11 allows a user to have two separate nail coatings available within a single applicator.

Alternatively, barrel 202 may have a lid (not shown) with a brush applicator (not shown) for applying the contents of barrel 202. In this alternative embodiment, valve seal 214 may be omitted to allow such a brush applicator to be dipped into barrel 202. For example, if barrel 202 contains nail gloss that is too viscous to effectively flow through nib 220, such a lid (or cap) with a brush applicator may be provided for such barrel to allow a user to apply such nail gloss. Thus, such an alternative modification allows a user to utilize a nib 120 to apply the contents of barrel 102 and utilize a brush applicator (not shown) to apply the contents of barrel 202. A stand (not shown) may also be provided to support the applicator 100. Such a stand may aid in preventing the applicator 100 from tipping over and spilling the contents of barrel 202 during the application of such contents by a user.

Various types of nail paint, gloss, and other nail coating substances may be applied using the embodiments described herein. However, such coating substances must have a viscosity level such that the coating substance will effectively flow from the applicator's barrel through the nib during the application process. Thus, the coating substance will preferably have different characteristics than that of most nail polishes available in the prior art. Most preferably, the coating substance (e.g., nail paint) utilized within the applicator has a viscosity less than 200 centipoise (cps). In a preferred embodiment, the painting solution currently manufactured by Speedball Art Products, Inc., Statesville, N.C., and utilized by Hunt Corporation in its paint pen is modified and adapted for use as nail paint. Such paint solution is non-toxic, and is actually intended to be safe for children to use, recognizing the possibility that children may inhale or ingest such paint. Moreover, the Hunt Corporation paint solution has a low viscosity level, such that the paint effectively flows from the applicator's barrel to the nib. Such paint solution can be modified to yield any color and opacity desirable for nail paint without changing the other properties of the solution, such as it being non-toxic and having relatively low viscosity. Furthermore, additional substances, such as nail conditioning (e.g., lanolin, fluoride, vitamin E and aloe vera) and anti-fungal agents (e.g., undecylenic acid and ethyl acetate) may be added to the paint solution. Although, adding one or more of such substances may result in an increase in the paint's toxicity. Additionally, the nail paint bonds well with a nail, and such nail paint bonds with itself allowing better results when the paint is touched-up resulting in consistent texture and color. Moreover, the nail paint bonds well with a solvent-based finish applied once the nail paint has dried. Moreover, the aqueous nail paint combined with a solvent-based finish creates a film with the desired appearance, durability and health characteristics. Moreover, such paint solution individually and combined with a solvent-based finish can be removed from the user's nails by simply applying any traditional nail polish remover.

In a preferred embodiment, the nail paint composition is generally prepared by mixing a suitable pigment slurry or paste with a latex. Generally, a latex is a stable dispersion of a polymeric substance in an essentially aqueous medium. That is, in a preferred embodiment, the pigment or pigments selected for use are ground in a mill base formulation to provide a paste or slurry composition which may be incorporated into a latex formulation to provide a finished coating composition (e.g., nail paint). While the novel formulations may be prepared without pigments, the compositions generally contain at least one pigment ingredient. The pigment paste or slurry is typically prepared by grinding a pigment or pigments in a mill base. In a preferred embodiment, such mill base may consist of an acid functional emulsified styrene/acrylic resin in an aqueous solution. More specifically, such mill base may consist of an acid functional styrene/acrylic polymer resin in an aqueous solution comprising water. Additionally, in a preferred embodiment, surfactants and dispersants may be included in the solution to aid pigment dispersion. Lastly, nail conditioning and anti-fungal agents may be included to aid in maintaining healthy nails.

Pigments may be ground individually as well as in combination to produce a desired pigment shade. The amount of pigment utilized in the preparation of the paste or slurry typically ranges from approximately 20% to approximately 80%. However, one skilled in the art should recognize that the amount of pigment incorporated into the mill base may depend on the specific properties of the pigment or pigments utilized (e.g., density), as well as the viscosity of the combined mill base and pigment and the processing equipment requirements. Preferred pigments for use in the mill base should be non-toxic, non-sensitizing, non-staining, essentially free from a tendency to bleed, insoluble in solvents and water, and exhibit good to excellent lightfastness. In a preferred embodiment, the combined pigment and mill base composition may be processed (milled) to provide a pigment paste or slurry composition wherein the average particle size of the pigment is in the range of approximately 0.1 microns to approximately 0.5 microns to reduce separation and provide good coloration.

In addition to the pigment slurry and latex, up to approximately 2% of dipropylene glycol methyl ether and up to approximately 6% of 2-Pyrrolidinone may be added to the let-down. That is, up to approximately 2% of dipropylene glycol methyl ether and up to approximately 6% of 2-pyrrolidinone may be added to the resulting combination of pigment slurry and latex. Accordingly, a resulting nail paint that is substantially water-based, as opposed to traditional solvent-based nail polishes, may be utilized in a preferred embodiment.

Utilizing the preferred embodiment discussed herein, applying a single coat of nail paint may provide the desired appearance. Thus, a user may be required to apply only a single coat of nail paint, rather than multiple coats. Additionally, in the preferred embodiment the nib is easily used for touching-up a previously applied coat of nail paint resulting in a consistent texture and color. Accordingly, should a coat of nail paint chip, it can be easily and effectively touched-up using the preferred embodiment having viscosity levels that permit such solutions to effectively flow through the applicator's nib.

In a preferred embodiment, various colors of nail paint are available to a user in a matte finish. Additionally, various "coating" or "finishing" formulas may be available to a user. For example, gloss, pearl, pearlescent, glitter, and matte protector finishes may be available to a user. Additionally, other finishing formulas now known or later developed may be available to a user. In a preferred embodiment, a user need only obtain one container of each desired color in a matte finish and one container of each desired finishing formula. Accordingly, a user is not required to obtain a separate container or formula for each combination of the colors and finishes that a user may desire. Turning to FIG. 12, a table is shown that illustrates an example of the number of separate formulas or containers that a user may be required to obtain to have the option of creating each combination of colors and finishes that a user may desire. As shown, a user may desire to have 6 different finishes available to the user (matte, gloss, pearl, pearlescent, glitter, and matte protector). Also, a user may desire to have 5 different colors available to the user in each finish (red, burgandy, pink, purple, and brown). Accordingly, for a user to have the desired colors available in each desired finish, the user may obtain a total of 30 different formulas or containers. That is, the user may obtain the 5 desired colors for each of the 6 desired finishes to have each of the desired options available to the user.

Turning now to FIG. 13, a table is shown that illustrates an example of the number of separate formulas or containers that a user may obtain to have the option of creating each combination of colors and finishes that a user may desire in a preferred embodiment of the present invention. As shown, a user may desire to have 6 different finishes available to the user (matte, gloss, pearl, pearlescent, glitter, and matte protector). Also, a user may desire to have 5 different colors available to the user in each finish (red, burgandy, pink, purple, and brown). However, in a preferred embodiment of the present invention, the user is required to obtain only 10 separate formulas or containers. That is, the user may obtain each nail paint color in a matte finish. Additionally, the user may obtain a single formula for each of the other types of finishes that the user desires (e.g., gloss, pearl, pearlescent, glitter, and matte protector). For example, a user may utilize a single gloss formula in conjunction with red, burgandy, pink, purple, and brown matte nail paint.

In a preferred embodiment, a user may first apply a nail paint having a matte finish to a nail. Such application may be performed using the pen-like applicator and nail paint as described above. Thereafter, the user may apply one or more of the selected finishing formulas to the matte nail paint. A finishing formula may be applied using a pen-like applicator as described above if the finishing formula has a viscosity level sufficiently low to permit effective flow through such an applicator. However, if the finishing formula does not have a viscosity level sufficiently low to permit effective flow through such an applicator, the finishing formula may be applied using a traditional brush or any other applicator now known or later developed for applying such a finishing formula. Accordingly, the user is not required to obtain a separate applicator or formula for each combination of finishes desired for a given nail paint color. Rather, the user may only obtain an applicator for each desired nail paint color in a matte finish, and one applicator for each of the desired types of finishing formulas. It should be understood that various nail paint colors other than those provided in the above examples may be available to a user. It should also be understood that various finishing formulas other than those provided in the above examples may be available to a user. Any such nail paint colors and finishing formulas now known or later discovered are intended to be within the scope of the present invention.

Turning to FIG. 14, an exemplary flow diagram is shown for a preferred method of applying nail paint. As shown, a user may first select a color to apply to a nail at block 1402. The color may be any color now known or later developed for nail paint. In a preferred embodiment, such color has a matte finish. Thereafter, the user may apply the selected color at block 1404. Such matte finish nail color may be applied to a nail using the above-described applicator and nail paint. The user may next select a finish, such as gloss, pearl, pearlescent, glitter, or matte protector, for the nail paint at block 1406. It should be understood that block 1406 may be performed before block 1404 (i.e., the user may select the finish prior to applying the nail paint). In fact, block 1406 may even be performed before block 1402 (i.e., the user may select the finish prior to selecting the nail paint color). Finally, at block 1408 the user may apply the selected finish to a nail or nails to which the selected nail paint color has previously been applied. Such selected finish may be applied to a nail using the above-described applicator if the selected finish has a viscosity sufficiently low enough to permit effective flow through the applicator. Alternatively, the selected finish may be applied to a nail using a traditional brush applicator or any other applicator now known or later developed. It should be noted that the user may elect to apply a clear base coat or "filler coat" prior to block 1402, although such an application is generally not necessary for the purposes of this invention.

As used herein, the term "nail" is intended to refer to both fingernails and toenails. Also, as described herein a nail paint applicator having a nib is provided for applying nail paint to a nail. It should be understood that the nail paint applicator described herein may be used for applying nail paint of any color, including clear nail paint. Further, the applicator may be used for applying nail paint having any finish, including a matte finish or a gloss finish. Additionally, the applicator may be used for applying nail gloss. Further still, the applicator may be utilized for applying various types of nail coating solutions. Moreover, the applicator may be used for applying a nail protectant solution. The applicator may also be utilized for applying various types of coating solutions utilized for strengthening nails, increasing a nail's growth, or other nail treatment solutions. Accordingly, the present invention is not intended to be limited to only nail paint, but may also encompass various other types of nail coating solutions having the characteristics and viscosity level as described above.

As described herein, in a preferred embodiment an applicator contains a valve and a nib such that nail paint contained within the barrel of the applicator flows to the nib when the nib is depressed inward thus opening the valve. However, various other methods for controlling the flow of nail paint from the applicator's barrel to the nib may be utilized. For example, other valves or seals may be utilized within the applicator, and any such modification is intended to be encompassed within the scope of the present invention. As another example, nail paint may be continuously provided to the applicator's nib, as typically utilized in magic markers and other writing utensils. Accordingly, the nib may be continually saturated with nail paint from the applicator's barrel, rather than only accessing nail paint from the applicator's barrel upon depressing the nib. Any such modification or implementation is intended to be within the scope of the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A nail paint applicator for applying nail paint to a nail, comprising:

a barrel for storing nail paint;

a nib coupled to said barrel, wherein a portion of said nib protrudes from said barrel for applying said nail paint to a nail; and wherein said nail paint is substantially water-based with a viscosity no less than 20 C.P.S. but sufficiently low to permit said nail paint to effectively flow through said nib.

2. The nail paint applicator of claim 1, further comprising:

said nib configured for applying said nail paint to a nail, wherein said nib is chisel shaped having curved corners to provide precision and control when applying said nail paint to a nail.

3. The nail paint applicator of claim 2, wherein said nib further has a bi-concaved shape, wherein one side of said chisel shaped nib is curved concavely and a side opposite said one side of said chisel shaped nib is curved concavely.

4. The nail paint applicator of claim 2, wherein said nib further has a plano-concaved shape, wherein one side of said chisel shaped nib is curved concavely and a side opposite said one side of said chisel shaped nib is substantially flat.

5. The nail paint applicator of claim 2, wherein said nib further has a meniscus shape, wherein one side of said chisel shaped nib is curved and a side opposite said one side of said chisel shaped nib is coincidentally curved as said one side.

6. The nail paint applicator of claim 1, wherein said nib is a material selected from the group consisting of:

a polymer material, an acrylic material, and a combination of polymer material and acrylic material.

7. The nail paint applicator of claim 1, wherein said nail paint is non-toxic.

8. The nail paint applicator of claim 1, further comprising:

said nail paint is a composition that is formed when mixing a pigment slurry with a latex;

said latex is a stable dispersion of a polymeric substance in a substantially water-based medium; and said pigment slurry is a composition that is formed when grinding one or more pigments in a mill base, wherein said mill base comprises an acid functional styrene/acrylic resin in water-based solution.

9. The nail paint applicator of claim 1, wherein said nail paint is selected from a group consisting of:

color nail paint, clear nail paint, matte color nail paint, gloss color nail paint, nail gloss, nail protectant, and nail coating.

10. The nail paint applicator of claim 1 wherein said water-based nail paint has a viscosity no less than 50 C.P.S.

11. The nail paint applicator of claim 1 wherein said water-based nail paint has a viscosity no less than 100 C.P.S.

12. A nail paint applicator for applying nail paint to a nail, comprising:

a barrel for storing nail paint;

a valve coupled to said barrel for restricting the flow of said nail paint from said barrel;

an end housing coupled to said barrel;

a nib coupled to said end housing, wherein a portion of said nib protrudes from said end housing;

said nib configured for applying said nail paint to a nail;

said nail paint being substantially water-based with a viscosity no less than 20 C.P.S. but sufficiently low to permit said nail paint to effectively flow through said nib.

13. The nail paint applicator of claim 12, further comprising:

said nail paint is a composition that is formed when mixing a pigment slurry with a latex.

14. The nail paint applicator of claim 13, further comprising:

said latex is a stable dispersion of a polymeric substance in a substantially water-based medium; and said pigment slurry is a composition that is formed when grinding one or more pigments in a mill base, wherein said mill base comprises an acid functional styrene/acrylic resin in water-based solution.

15. The nail paint applicator of claim 13, further comprising:

said nail paint composition further comprises approximately 2% or less of dipropylene glycol methyl ether; and said nail paint composition further comprises approximately 6% or less of 2-pyrrolidinone.

16. The nail paint applicator of claim 12, wherein said nail paint has a viscosity not greater than 200 centipoise (cps).

17. The nail paint applicator of claim 12 wherein said water-based nail paint has a viscosity no less than 50 C.P.S.

18. The nail paint applicator of claim 12 wherein said water-based nail paint has a viscosity no less than 100 C.P.S.

19. A method for applying nail paint to a nail resulting in a desired finish, comprising:

selecting a desired nail paint color having a matte finish, wherein said nail paint color is substantially water-based with a viscosity no less than 20 C.P.S.;

applying said nail paint color having a matte finish to a nail using a nail paint applicator, wherein said nail paint applicator comprises a barrel for storing said nail paint and a nib configured for applying said nail paint to a nail;

selecting a desired finishing formula; and applying said finishing formula to a nail using a finishing formula applicator after said step of applying said nail paint color has been performed.

20. The method of claim 19, wherein said step of applying said nail paint color having a matte finish to a nail further comprises:

applying inward pressure to said nib protruding from said barrel containing nail paint;

in response to said inward pressure to said nib, said nib applying inward pressure to a valve that seals said nail paint stored in said barrel;

said inward pressure to said valve being sufficient to cause said valve to open allowing a volume of said nail paint to flow to said nib;

removing said inward pressure from said nib;

in response to removing said inward pressure from said nib, said nib removing said inward pressure from said valve such that said valve seals to prevent said nail paint contained in said barrel from flowing to said nib; and applying said volume of nail paint from said nib to a nail.

21. The method of claim 19, wherein said nail paint is a non-toxic paint having a viscosity such that said nail paint may effectively flow from said barrel through said nib.

22. The method of claim 19, wherein said nail paint is a composition that is formed when mixing a pigment slurry with a latex.

23. The method of claim 19, wherein said finishing formula is selected from a group consisting of:

gloss, pearl, pearlescent, glitter, and nail protectant.

24. The method of claim 19, wherein said finishing formula applicator is selected from the group consisting of:

a pen like applicator having a barrel for storing said finishing formula and a nib configured for applying said finishing formula to a nail, and a brush for applying said finishing formula to a nail.

25. The method of claim 19 wherein said finishing formula is substantially water-based.

26. The method of claim 19 wherein said finishing formula is substantially solvent-based.

27. The method of claim 19 wherein said water-based nail paint has a viscosity no less than 50 C.P.S.

28. A method for coating a nail resulting in a durable film having a desirable finish, comprising:

applying an aqueous-based nail paint having a viscosity no less than 20 C.P.S. to said nail with a pen-like applicator; and applying a finishing formula to said nail, wherein said finishing formula and said aqueous-based nail paint form said film.

29. The method of claim 28, wherein said aqueous-based nail paint has a matte finish.

30. The method of claim 28, wherein said pen-like applicator comprises a barrel for storing said aqueous-based nail paint and a nib configured for applying said aqueous-based nail paint to a nail.

31. The method of claim 30, wherein said aqueous-based nail paint is a non-toxic paint having a viscosity sufficiently low such that said nail paint may effectively flow from said barrel through said nib.

32. The method of claim 28, wherein said nail paint is a composition that is formed when mixing a pigment slurry with a latex.

33. The method of claim 28, wherein said finishing formula is selected from a group consisting of:

gloss, pearl, pearlescent, glitter, and nail protectant.

34. The method of claim 28, wherein said step of applying said finishing formula further comprises:

applying said finishing formula with an applicator that comprises a barrel for storing said finishing formula and a nib configured for applying said finishing formula to a nail.

35. The method of claim 24 wherein said finishing formula is substantially aqueous-based.

36. The method of claim 28 wherein said finishing formula is substantially solvent-based.

37. The method of claim 28 wherein said aqueous-based nail paint has a viscosity no less than 50 C.P.S.

38. A pen-like applicator for applying a water-based nail paint to a nail, comprising:

a barrel for storing said water-based nail paint, said water-based nail paint having a viscosity no less than 20 C.P.S.; and a nib for applying said water-based nail paint to a nail.

39. The pen-like applicator of claim 38 wherein said water-based nail paint has a sufficiently low viscosity level to permit said water-based nail paint to effectively flow through said nib for application to a nail.

40. The pen-like applicator of claim 39 wherein said water-based nail paint has a viscosity not greater than 200 C.P.S.

41. The pen-like applicator of claim 38 wherein said water-based nail paint has a viscosity no less than 50 C.P.S.

42. The pen-like applicator of claim 38 wherein said water-based nail paint has a viscosity no less than 100 C.P.S.

43. The pen-like applicator of claim 38 wherein said water-based nail paint is non-toxic.

44. The pen-like applicator of claim 43 wherein said nail paint composition further comprises approximately 2% or less of dipropylene glycol methyl ether, and wherein said nail paint composition further comprises approximately 6% or less of 2-pyrrolidinone.

45. The pen-like applicator of claim 38 wherein said water-based nail paint includes cosmetic grade pigments.

46. The pen-like applicator of claim 38 wherein said barrel comprises a housing for storing said water-based nail paint, said housing removably coupled to said barrel, such that another housing containing nail paint may be removably coupled to said barrel in place of said housing.

* * * * *